United States Patent [19]

Day

[11] 4,315,383

[45] Feb. 16, 1982

[54] INNER GEAR DRIVE FOR ABRADING MACHINES

[75] Inventor: Lawrence Day, Mount Prospect, Ill.

[73] Assignee: Spitfire Tool & Machine, Co. Inc., Chicago, Ill.

[21] Appl. No.: 149,347

[22] Filed: May 13, 1980

[51] Int. Cl.[3] ..... B24B 5/00

[52] U.S. Cl. ..... 51/118; 51/133

[58] Field of Search ..... 51/117, 118, 131.2, 51/131.3, 131.4, 133

[56] References Cited

U.S. PATENT DOCUMENTS

| | | | |
|---|---|---|---|
| 2,419,033 | 4/1947 | Primas | 51/118 |
| 2,709,876 | 6/1955 | Ihdge | 51/118 |
| 3,662,498 | 5/1972 | Caspers | 51/118 |
| 3,691,694 | 9/1972 | Goetz | 51/118 |

*Primary Examiner*—Harold D. Whitehead

[57] ABSTRACT

An overhead center pin drive gear for gear-shaped work carriers for two-lap lapping or finishing machines which will rotate the pin-driven gear-shaped work carriers about their respective axes independently of the rotation of the lapping plates.

8 Claims, 4 Drawing Figures

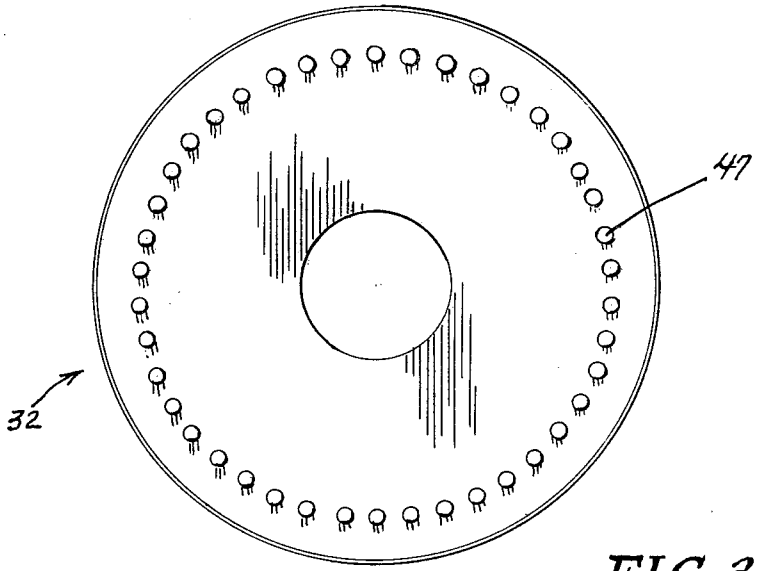
FIG. 3.
FIG. 4.
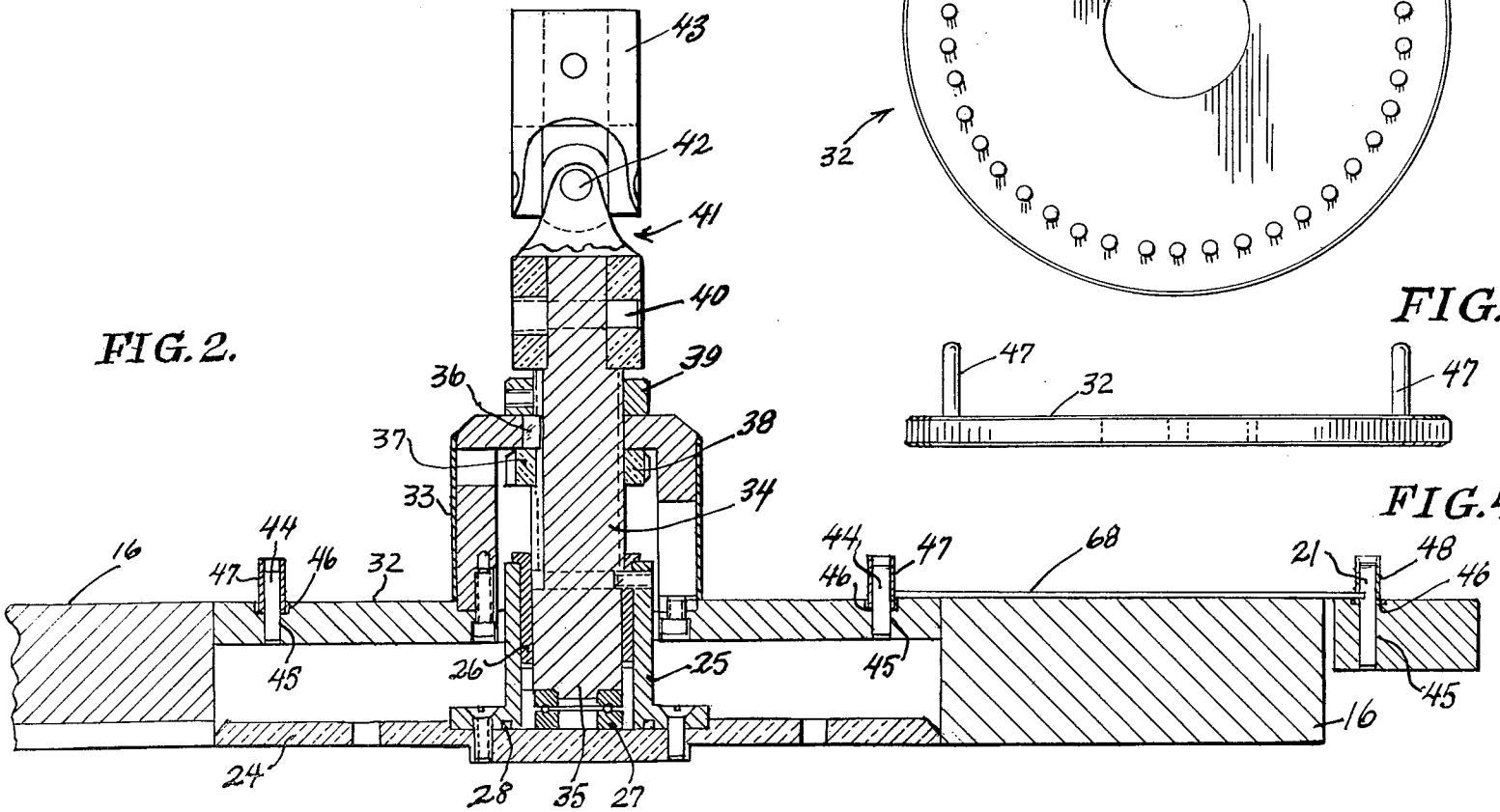
FIG. 2.

INNER GEAR DRIVE FOR ABRADING MACHINES

SUMMARY OF THE INVENTION

The invention is related to a two-lap lapping machine, and, more particularly, to the drive mechanism for the center pin drive gear that functions to rotate cooperating gear-shaped work carriers about their respective axes independently of the direction of rotation of the lapping plates.

In the customary two-lap lapping machines, the inner gear plate lies coplanar with the bottom lap plate and has its drive mechanism projecting upwardly through the center of the lap plate. This arrangement requires extensive sealing of the drive mechanism to prevent the fluid abrasive material used in the lapping operation from accumulating in the center opening and damaging the structure.

In the present invention, the inner pin gear, while lying in the same plane of the bottom lap, is driven by an overhead drive mechanism which functions independently of the drive mechanisms for either the bottom or top lap plate. The drive mechanism is independently suspended relative to the top plate, which is adapted to be moved vertically into and out of working position with respect to the bottom lap plate.

This invention relates to an overhead gear drive including a depending driven shaft which, through a universal joint, is connected to a drive coupling shaft that, in turn, has an adjustable driving connection to an inner pin drive gear.

The inner pin drive gear is provided with a plurality of vertically extending gear pins equally spaced about its periphery. Each pin functions as a gear tooth and meshes and drives a gear-shaped work carrier over and independently of the rotating lap plates.

In abrading machines of this type employing an annulus of equi-distant upwardly extending vertical pins effecting a sun gear planetary transmission, there is required a constant replacement for worn out or worn down pins. It is an object of this invention to provide a protective replacement gear sleeve for such pins overcoming the objectionable features above noted.

GENERAL DESCRIPTION OF DRAWINGS

The invention will be best understood by reference to the accompanying drawing, which illustrates the preferred embodiment of the invention by which the objects thereof are obtained and in which:

FIG. 2 is a fragmentary detailed sectional view of the inner drive mechanism;

FIG. 3 is a top plane view of the circular inner drive gear of this invention; and FIG. 4 is a side elevational view of the inner drive gear of this invention.

GENERAL DESCRIPTION

Figure 1:
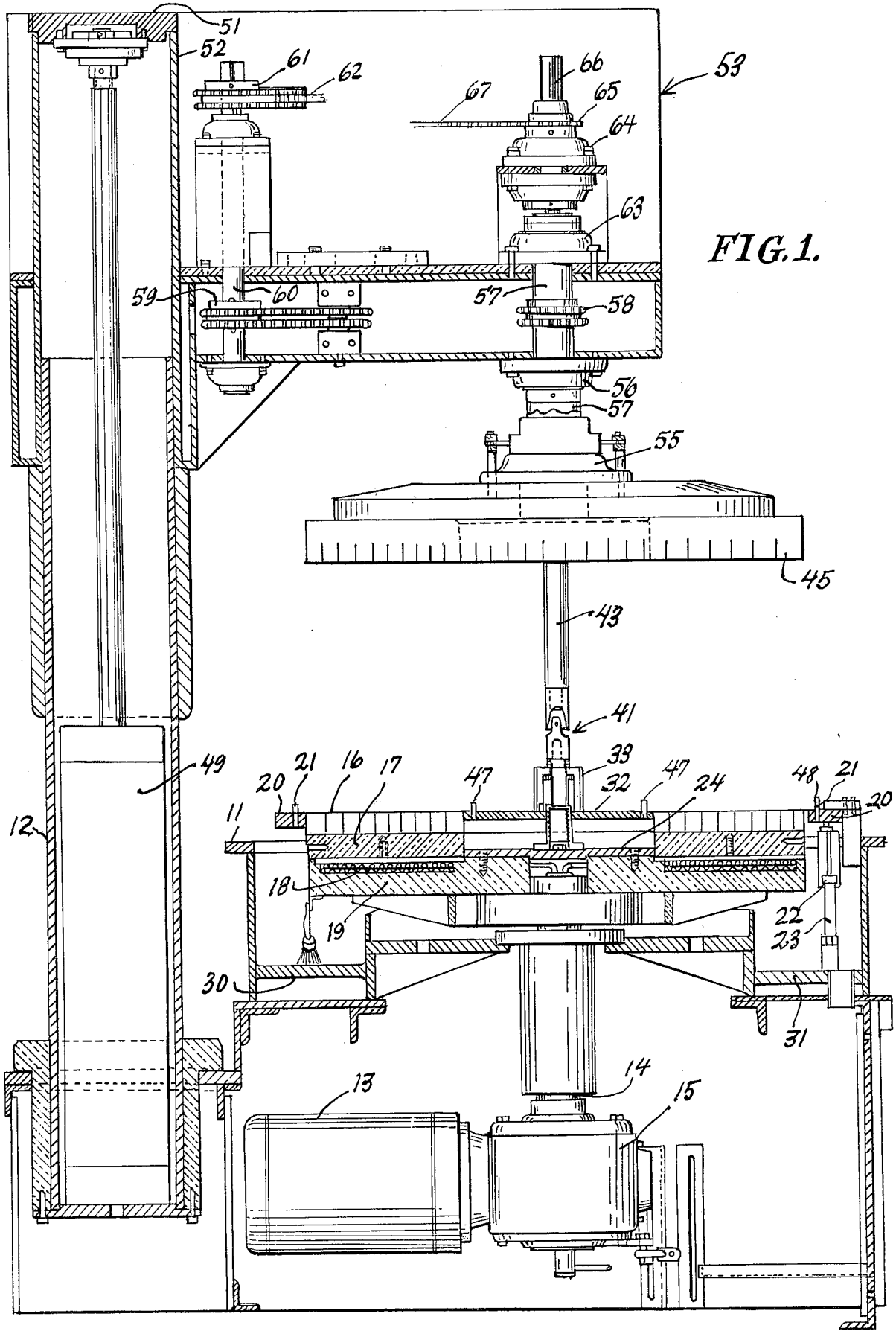
FIG. 1 is a side elevational sectional view of the machine.

In FIG. 1, there is illustrated a complete machine that includes a base 10 having a circular table top 11 and an upright hollow standard 12.

Within the base 10, there is an electrical reversible motor 13 adapted to rotate a shaft 14 through a suitable gear box 15. The shaft 14, in turn, is connected to and adapted to rotate a ring-shaped lower machining plate or lap 16.

As shown, the lap 16 is mounted on an intermediate plate 17 that sits upon a cooling coil 18 housed in a subplate 19.

Mounted about the periphery of the lap 16 is a ring 20 that supports a plurality of equally distant gear pins 21. The ring 21 is connected to one end of a plunger 22 of a cylinder 23 that functions to vertically adjust the ring 20 together with its ring pins 21 relative to the horizontal plane of the upper face of the lap 16.

Connected to the sub-plate 19 within the center opening of the lap 16 is a driven coupling plate 24. This plate 24 supports a bushing 25 that in turn holds a sleeve bearing 26 that also houses a thrust bearing 27. Between the bushing 25 and the coupling plate 24 is an "O" ring 28 for sealing the connection therebetween.

It should be noted that the outer periphery of the lap 16 as well as the sub-plate 19 extends into a well 29 formed by partitions 30 and 31 within the base 10. It is into this well 29 that the liquid abrasive will flow through centrifugal action created by the rotation of the lap 16 during normal operation. The center opening of the lap 16 is closed and sealed by coupling plate 24 and the sub-plate 19 so that there is no access to the shaft 14, the gear box 15, or the motor 13 contained within the base 10.

Also positioned within the center opening of the lap 16 is a circular inner drive gear 32. This gear 32 is connected to the lower end of a drive coupling cup 33. As shown in FIG. 2, the upper portion of bushing 25 as well as the sleeve bearing 26 project into the coupling cup 33.

Journalled through the center of the cup 33 is a drive coupling shaft 34. The lower end 35 of the shaft 34 sits upon the thrust bearing 27 contained within the bushing 25. The shaft 34 is connected to the cup 33 by a key 36 that extends into a keyway 37 formed partially throughout the longitudinal length of the shaft 34 as shown.

A portion of the shaft 34 is externally threaded and receives a height adjustment nut 38 adapted to be positioned within the cup 33 as well as a locking nut 39 positioned externally of the cup 33. By a pin 40 the shaft 34 is coupled to a universal joint 41, which in turn is connected by a pin 42 to a driven spindle 43.

The inner gear 32 provides a plurality of drive pins 44 set in openings 45 formed about the periphery of the inner gear 32.

An enlarged counterbore 46 surrounds each opening 45 on the exposed surface of the gear 32. This counterbore 46 is adapted to receive a protective sleeve 47 frictionally fitted upon each of the drive pins 44.

As shown in FIG. 2, the gear pins 21 carried by the stationary ring 20 are positioned in a like counterbore and also receive protective sleeves 48.

It has been proven from prior apparatuses that due to the continuous drive engagement between the drive pins and the work carriers, dressing rings or dressing plates, and through the presence of the abrasives used during normal operation, the gear pins deteriorate and wear unevenly. This necessitates continuous replacement. Through the use of the protective sleeves such as is shown at 47 and 48, the gear pins are protected during operation with the sleeves readily replaceable as they wear without the necessity of extensive shutdown time for the machine.

It should be noted that the sleeves 47 and 48 are of a length greater than their corresponding pins. The sleeves 47 and 48 therefore project above the top of their corresponding pins so as to aid their removal when necessary. The sleeves also project into the counterbores surrounding the openings which contain the gear pins so that the sleeves lie beneath the plane surface of the gear 32 and lap 16. This is required in order to prevent the edge of the work carrier from working beneath the sleeve and deteriorating the same through excess frictional engagement during operation.

The hollow standard 12 houses a cylinder 49 and its movable piston 50. The free end of the piston 50 is connected to a top plug 51 of a sleeve 52, which in turn supports a housing 53 for the drive mechanism of the upper lap 54.

The upper lap 54 provides bearings 55 and 56 for its spindle 57. The spindle 57 is provided with a drive sprocket 58 that is in turn connected by a chain drive to a drive sprocket 59 mounted on a shaft 60. The upper end of the shaft 60 provides another sprocket 61 which, through a drive chain 62, is connected to and driven by a suitable motor (not shown) positioned within the housing 53.

The shaft 43 projects upwardly from its connection to the inner gear 32 through the center of the upper lap 54 and is journalled in the drive spindle 57. The upper end of the shaft 43 is supported by suitable bearings 63 and 64 which permit longitudinal movement of the shaft 43 therethrough.

A sprocket 65 is keyed to a keyway 66 formed in the wall of the shaft 43 and it in turn, by a drive chain 67, is connected to the motor not shown.

When the cylinder 49 is activated and the piston 50 is extended it will raise the upper plate 54 and its drive mechanism longitudinally of the shaft 60 and in a spaced parallel relation to lap 16.

A plurality of gearlike work carriers 68 can then be placed on the lap 16 in contact with the gear pins 47 and 48. The cylinder 49 is then deactivated and the piston 50 will lower the upper lap 54 into contact with the exposed top surface of the work carriers 68. Thus, the work carriers are positioned between the lower lap 16 and the upper lap 54 whereby each lap may perform an abrading function on the work piece carried by such work carriers.

Through the drive arrangement hereinbefore described the upper lap 54 may be caused to rotate in one direction while the inner gear 32 may be rotated in an opposite direction. Both of the rotational movements may be at speeds varying with each other as well as the speed of rotation of the lower lap 16.

From the foregoing it is apparent that I have provided a double lap abrading machine that will achieve all of the stated objects of the invention.

While I have illustrated and described the preferred form of construction for carrying my invention into effect, this is capable of variation and modification without departing from the spirit of the invention. I, therefore, do not wish to be limited to the precise details of construction as set forth, but desire to avail myself of such variations and modifications as come within the scope of the appended claims.

Having thus described my invention what I claim as new and desire to protect by Letters Patent is:

1. In an abrading machine comprising, (a) upper and lower ringlike lap plates, each having an annular lap surface parallel to each other, (b) means for independently rotating each of said lap plates about its own vertical axis, (c) means supporting said upper lap plate and its rotating means for vertical movement relative to said lower lap plate, (d) gearlike work carrying means carried on said lower lap plate, (e) gear means in the plane of the annular lap surface of said lower lap plate for rotating said gearlike work carrying means relative to said lap surfaces independently of the rotation of said lap plates, and (f) an overhead drive means for said gear means carried by said upper lap plate supporting means and including a rotatable drive shaft freely journalled through the center of said upper lap plate and said supporting means and being connected to said gear means for rotating the same in the plane of the annular lap surface of said lower lap plate, independently of the rotation of said upper and lower lap plates.

2. In an abrading machine as defined by claim 1 wherein said means supporting said upper lap plate and its rotating means comprises a hollow, vertically disposed standard embraced by a free-moving sleeve, a pneumatic cylinder, and piston within said standard with said piston connected to said sleeve for vertical movement thereof relative to said machine, and a housing for said rotating means for said upper lap plate and said overhead drive means mounted on and vertically movable with said sleeve.

3. In an abrading machine as defined by claim 1 wherein said gear means comprises a circular plate providing a plurality of drive pins set in openings formed about the periphery of said plate with said pins extending above said annular lap surface of said lower lap plate.

4. In an abrading machine as defined by claim 3 including removable protective sleeves frictionally journalled upon each of said drive pins with said sleeves projecting beyond the free end of said pins and into said openings beneath said annular lap surface of said lower lap plate.

5. In an abrading machine as defined by claim 2 wherein said gear means comprises a circular plate providing a plurality of drive pins set in openings formed about the periphery of said plate with said pins extending above said annular lap surface of said lower lap plate.

6. In an abrading machine as defined by claim 5 including removable protective sleeves frictionally journalled upon each of said drive pins with said sleeves projecting beyond the free end of said pins and into said openings beneath said annular lap surface of said lower lap plate.

7. In an abrading machine including gearlike work carriers adapted to be mounted on the rotatable lap plate of the machine while having independent rotation relative thereto comprising;

(a) means for rotating the gearlike work carriers about their vertical axes, (b) said means providing a circular plate lying in the plane of the lap plate of the machine and rotated by said rotating means, (c) gear pins carried about the periphery of the lap plate and extending at right angles to the normal plane thereof and having contact with the periphery of the gearlike work carriers for rotating the same, (d) removable wear protecting means mounted upon said pins, (e) said circular plate providing a plurality of openings formed about its periphery with each opening being provided with a partial enlarged counterbore for receiving said gear pins and wear protective means whereby said wear protective means will extend beneath the abrading surface of the rotatable lap plate when mounted upon said gear pins.

8. In an abrading machine as defined by claim 7, including removable protective sleeves frictionally journalled upon each of said gear pins with said sleeves projecting beyond the free end of said pins and into said counterbore beneath said abrading surface of the rotatable lap plate.

* * * * *